US012065847B1

(12) United States Patent
Brookheart

(10) Patent No.: US 12,065,847 B1
(45) Date of Patent: Aug. 20, 2024

(54) SKYLIGHT LEAK REPAIR

(71) Applicant: VADA, LLC, Olney, IL (US)

(72) Inventor: Brian E. Brookheart, Olney, IL (US)

(73) Assignee: VADA, LLC, Olney, IL (US)

( * ) Notice: Subject to any disclaimer, the term of this patent is extended or adjusted under 35 U.S.C. 154(b) by 0 days.

(21) Appl. No.: 18/440,132

(22) Filed: Feb. 13, 2024

Related U.S. Application Data

(63) Continuation of application No. 18/136,436, filed on Apr. 19, 2023, now abandoned.

(60) Provisional application No. 63/334,864, filed on Apr. 26, 2022.

(51) Int. Cl.
*E04G 23/02* (2006.01)
*E04D 13/03* (2006.01)

(52) U.S. Cl.
CPC ..... *E04G 23/02* (2013.01); *E04D 13/031* (2013.01)

(58) Field of Classification Search
CPC ... E04G 23/02; E04G 23/0281; E04D 13/031; E04D 13/03; E04D 13/0335; E04D 13/033; E06B 9/24; B60J 7/0084; B60R 13/07
See application file for complete search history.

(56) References Cited

U.S. PATENT DOCUMENTS 5,237,788 A * 8/1993 Sandow ..... E04D 13/0335 52/200
6,209,271 B1 * 4/2001 Kovacs ..... E04D 13/0335 52/106
9,194,128 B1 * 11/2015 Fawley ..... E04D 13/033
11,773,611 B1 * 10/2023 Fineran ..... E04G 21/30 52/3
2007/0193122 A1 * 8/2007 Diaz ..... E04G 21/28 52/3
2008/0209835 A1 * 9/2008 Margarites ..... E04G 23/02 52/518
2012/0321858 A1 * 12/2012 Seelmann ..... B32B 5/02 264/526

* cited by examiner

*Primary Examiner* — Andrew J Triggs
(74) *Attorney, Agent, or Firm* — Grace J. Fishel

(57) ABSTRACT

A skylight leak repair kit and method especially adapted for use in repairing a skylight damaged dome mounted in a metal frame on a commercial flat roof. Required equipment includes an oversized sheet formed of PVC membrane which is 12 oz to 20 oz per yard in weight and reinforced with a mesh network of fibers, sticks of termination bar about 1 inch high with pre-punched holes spaced about 6" to 8" on center, self-tapping metal screws with plastic washers. Steps include draping the sheet, positioning sections of the termination bar along the metal frame, pleating the sheet along the sides and securing the sheet along the metal frame with the self-tapping metal screws while avoiding the pleats but coming within inches of the corners with the termination bars.

3 Claims, 4 Drawing Sheets

SKYLIGHT LEAK REPAIR

BACKGROUND OF THE INVENTION

Field of the Invention

The present invention relates to a system for skylight leak repair and fall protection.

Brief Description of the Prior Art

The construction of a typical skylight is shown in FIG. 1. As shown, a skylight includes a metal frame defining an outer perimeter of the glass structure usually comprising first and second sheets of glass. Gaskets are provided between the outer sheet of glass and the frame and between the outer and inner sheets of glass. The frame of the skylight is mounted on the roof with underlayments and flashings which make a good seal.

All skylights will eventually leak. When a skylight starts leaking, it is usually because the gasket seal has cracked between the outer sheet of glass and the metal frame and the watertight integrity of the acrylic or glass has been compromised.

Skylight replacement or retrofitting if retrofitting is even a possibility is costly and therefore there has been great public interest in trying to seal a leak between the glass and the metal frame to defer replacement cost as long as possible. Prior art techniques include caulking, tar and tapes. Caulk and tar dry out and fail. It addition they are unsightly when viewed from above or below as they are typically squeezed on with a tube or brushed on and form a ragged edge inside the outer glass sheet, black in the case of tar. Tapes peel and if used to tape over the entire window block sunlight and defeat the purpose of having a skylight. Another prior art solution is a clear silicone coating that is painted over the skylight to provide a water seal. A problem with most of the prior art techniques is that the seam between the glass and the frame needs to be scraped open with a hand tool and in some instances the window cleaned with solvent before the caulk, tar, tape or silicone is applied. For this, an operator must crawl around the skylight to reach all the seams which even on a flat roof is dangerous and more so if the roof is steeply pitched. Falls through the glass resulting in many instances with death are not uncommon.

BRIEF SUMMARY OF THE INVENTION

In view of the above, it is an object of the present invention to provide a skylight leak repair system that addresses most or all of the above mentioned problems. Other objects and features of the invention will be in part apparent and in part pointed out hereinafter.

In accordance with the invention, a skylight leak repair kit comprises a sheet formed of a translucent or transparent membrane, termination bars with pre-punched holes, screws and washers. The sheet is formed of PVC reinforced with a mesh network of polymeric washers and about 12 oz to 20 oz per yard in weight. In use the repair kit may be used to repair a leaking skylight by:

- draping the translucent or transparent sheet over the skylight frame extending at least partway down the side walls of the skylight frame;
- positioning the termination bar with the pre-punched holes over the membrane along the metal frame of the skylight;
- using the pre-punched holes, screwing the termination bar to the metal frame.

In addition to stopping the skylight from leaking, the sheet is sufficiently secured to the metal frame and strong enough with the mesh reinforcement that it may stop a worker from accidentally falling through the skylight very possibly to his or her death.

The invention summarized above comprises the constructions and methods hereinafter described, the scope of the invention being indicated by the subjoined claims.

BRIEF DESCRIPTION OF THE SEVERAL VIEWS OF THE DRAWINGS

In the accompanying drawings, in which one of various possible embodiments of the invention is illustrated, wherein.

DETAILED DESCRIPTION OF AT LEAST ONE PREFERRED EMBODIMENT OF THE INVENTION

Figure 1:
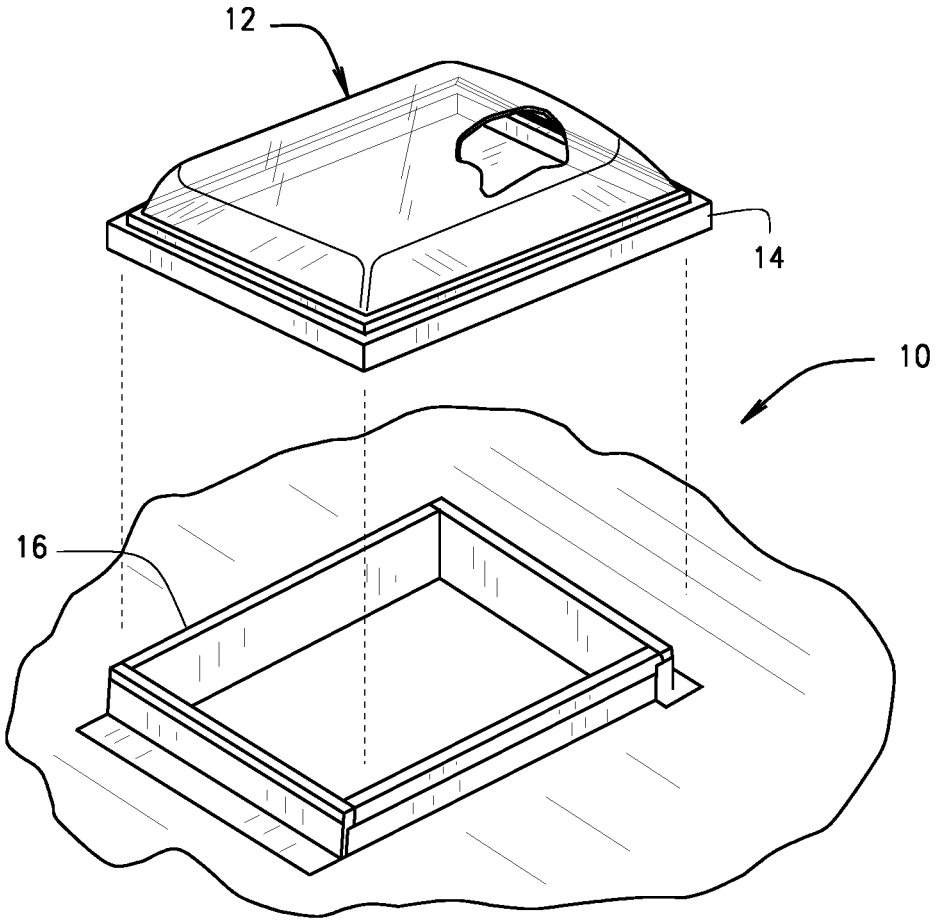
FIG. 1 is an exploded view of a typical skylight.
Figure 2:
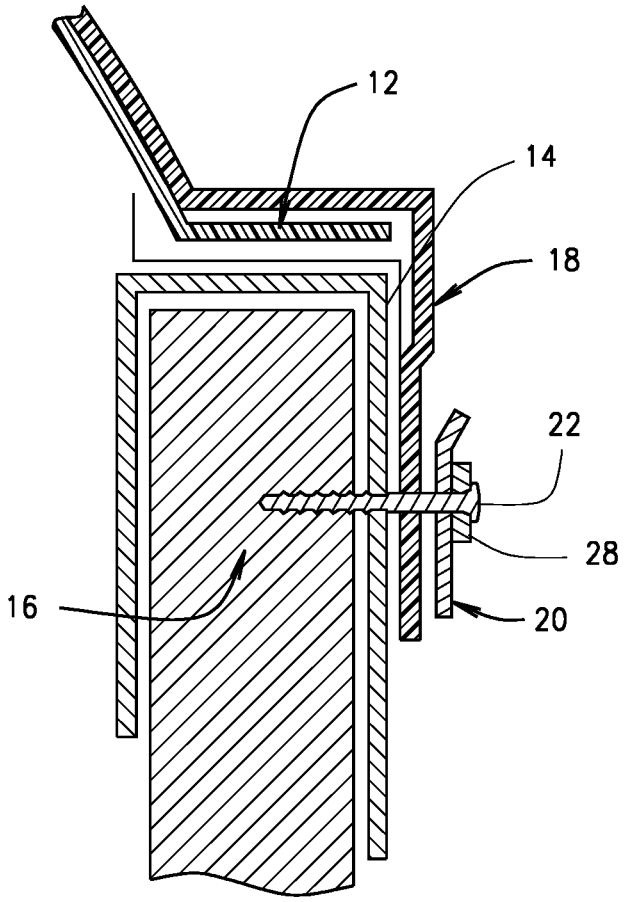
FIG. 2 is a sectional view showing a sheet of reinforced PVC attached to a metal frame of the skylight with a termination bar and screw.

Referring to the drawings more particularly by reference character, as shown in FIG. 1 a skylight 10 with a damaged dome 12 is mounted in a metal frame 14. Frame 14 is seated on a curb 16 as schematically shown in FIG. 2.

A repair kit comprised of a sheet of flexible PVC membrane 18, termination bars 20 and screws 22 are carried to the roof. For most cases, a sheet measuring 60" by 9'6" is sufficient (i.e., oversized) for most skylights found in commercial buildings. It being obvious that sheet 18 should be scaled for the particular skylights being repaired. The PVC membrane may be transparent or translucent but the less translucent the film is, the more UV stable the film is. The flexible PVC membrane is reinforced with a mesh network 34 of polymeric fibers and is preferably about 12 oz to 20 oz per yard in weight.

Figure 3:
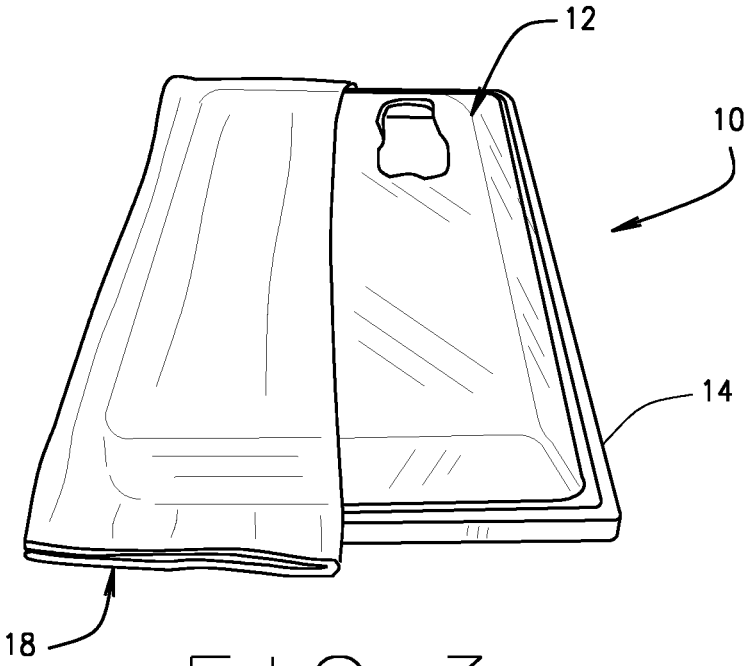
FIG. 3 illustrates the folded sheet placed over the skylight.
Figure 4:
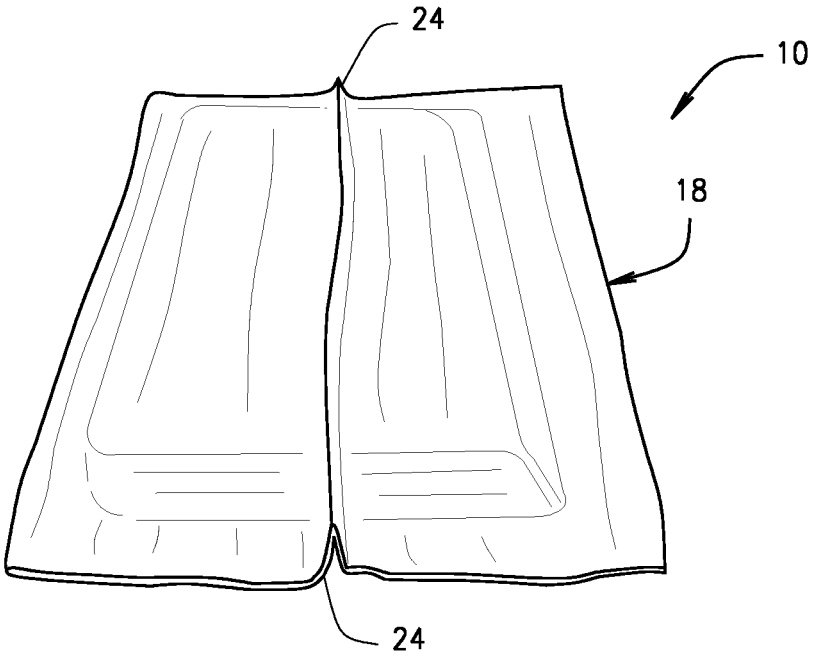
FIG. 4 shows pleats to make the sheet lay flat over the skylight.

As a first step, any loose debris may be brushed off the skylight and sheet 18 folded and placed over skylight 10 as shown in FIG. 3. Sheet 18 is then unfolded over skylight 10 as shown in FIG. 4. With continuing reference to FIG. 4, if sheet 18 does not lay flat on dome 12, sheet should be pleated 24 as shown to take up the slack.

Sheet 18 is then attached to metal frame 14 of skylight 10 with termination bars 20. Termination bars 20 are typically made of extruded metal such as steel or aluminum or plastic but plastic is preferred for skylight repair because the bars are easily cut in the field. Termination bars 20 are about ⅛ inch thick and 1 inch tall with pre-punched holes 26 for fasteners 22 and typically come in 10-foot-long sticks. For use in mending a commercial skylight 10, three 10' lengths are usually sufficient. Pre-punched holes 26 typically are ¼" in diameter and spaced 6" or 8" on center.

Figure 5:
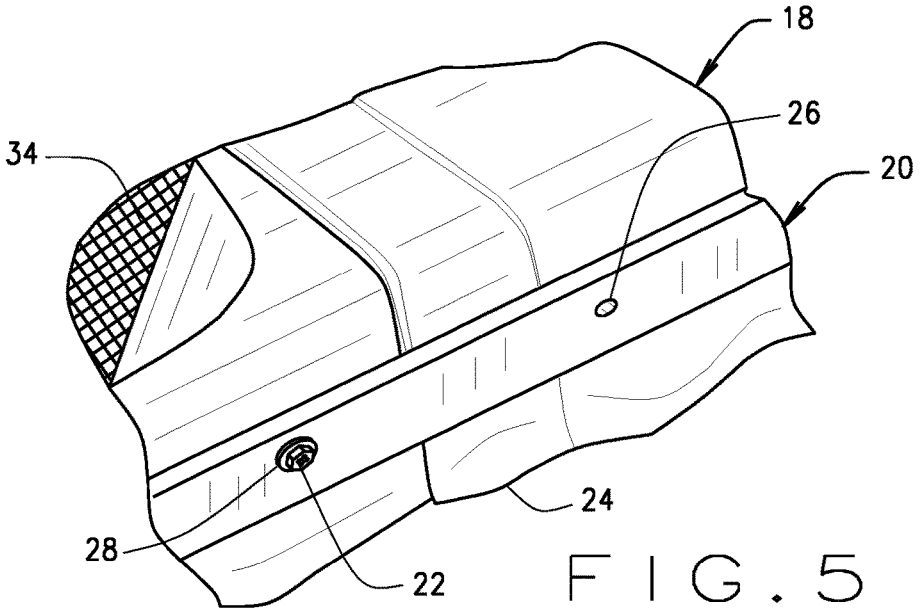
FIG. 5 shows attachment of the sheet to the metal frame using termination bars and mechanical fasteners.
Figure 6:
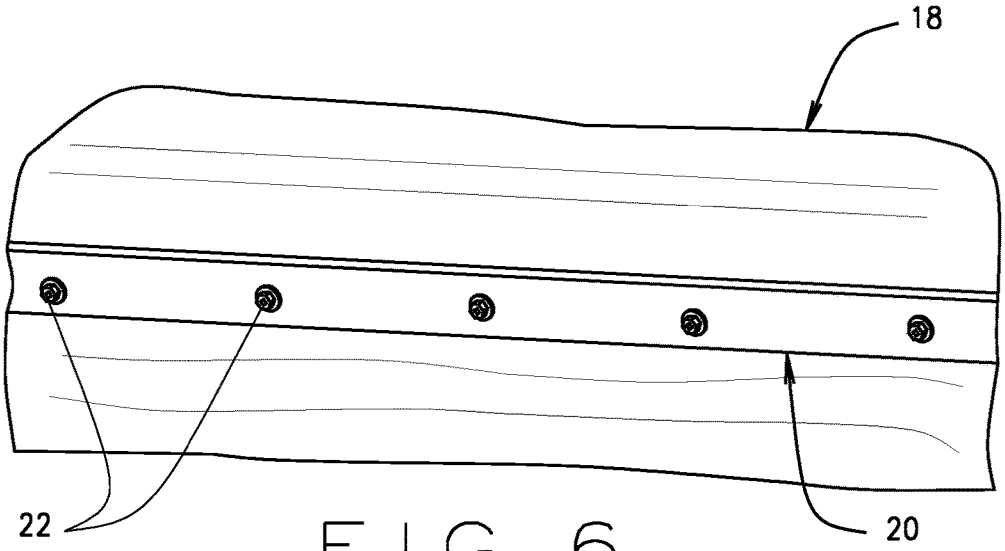
FIG. 6 shows every termination bar hole filled with a mechanical fastener; and, FIG. 7 shows the sheet hanging below the metal frame forming a water repellent skirt.
Figure 7:
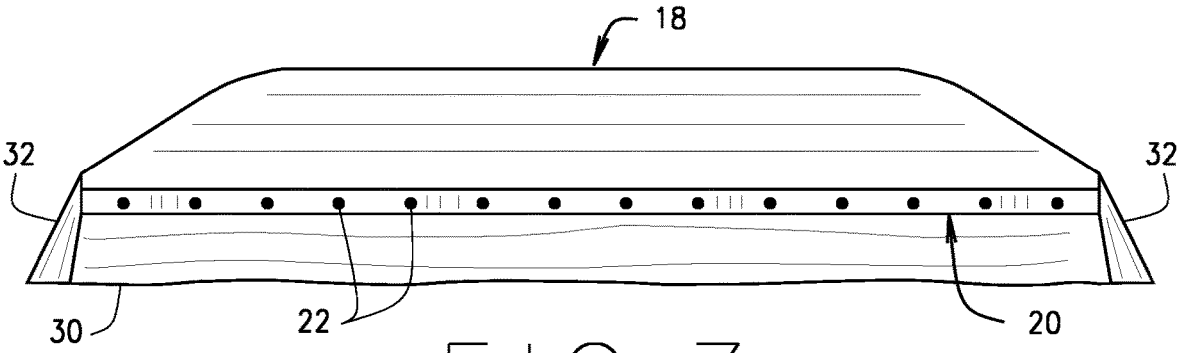

Working along a side of metal frame 14, sheet 18 is pressed against the frame with a length of termination bar 20 and fastened with mechanical fasteners such as self tapping screws 22 as shown in FIG. 5. Pleats 24 as needed are created between the fasteners. Every hole 26 should be filled taking care not to put a fastener through one of pleats 24. EPDM, neoprene or other polymer washers 28 may be used with screws 22 to reinforce the membrane around the fasteners and provide for a better seal. Sheet 18 should be pressed tight at the corners with a termination bar coming within about 1" of the corner and above process repeated around the sides of metal frame 14.

Sheet 18 is purposefully oversized for skylight 10 such that a skirt 30 of membrane hangs below metal frame 14 adding to the seal. While skirt 30 may be trimmed, for best repair, not trimming the overhang is preferred.

In addition to sealing skylight 10, sheet 18 reinforced with mesh 34 may be sufficient to stop a worker from accidentally falling through the skylight. Falling through old, brittle skylights is a problem resulting unfortunately not infrequently in deaths and such old skylights are just the kind that leak.

In view of the above, it will be seen that the several objects of the invention are achieved and other advantageous results attained. As various changes could be made in the above constructions and methods without departing from the scope of the invention, it is intended that all matter contained in the above description or shown in the accompanying drawings shall be interpreted as illustrative and not in a limiting sense.

What is claimed:

1. A method for repairing a skylight leak for a damaged dome mounted in a metal frame having corners comprising the following steps:

draping an oversized sheet larger in size than the dome and metal frame, said sheet formed of a translucent or transparent PVC membrane which is about 12 oz to 20 oz per yard in weight and reinforced with a mesh network of polymeric fibers, positioning sections of a plastic termination bar with pre-punched holes outside the sheet and along the metal frame;

driving self tapping fasteners into the metal frame through each of the pre-punched holes in the termination bar;

pressing the sheet at each of the corners into a fold and securing the fold with a fastener through the sections of the termination bar within about 1 inch of the corner; and, allowing the oversized sheet to hang below the metal frame forming a skirt.

2. The method of claim 1 wherein pleats are formed in the sheet along the termination bar such that the sheet lays flat on the dome.

3. The method of claim 1 wherein the self tapping fasteners are screws.

* * * * *